United States Patent [19]

Lord

[11] 4,336,579

[45] Jun. 22, 1982

[54] LAMP ASSEMBLY WITH SWITCH AND FOCUSSING MECHANISMS

[75] Inventor: Ronald D. Lord, Willowdale, Canada

[73] Assignee: Mining Industry Research Organization of Canada, Toronto, Canada

[21] Appl. No.: 189,239

[22] Filed: Sep. 22, 1980

[51] Int. Cl.[3] ..... F21V 21/26

[52] U.S. Cl. ..... 362/272; 362/282; 362/287; 362/295; 362/372; 362/424; 362/428

[58] Field of Search ..... 362/14, 60, 164, 165, 362/184, 187, 188, 190, 197, 212, 213, 220, 232, 238, 239, 259, 254, 285, 394, 429, 271, 272, 282, 287, 295, 371, 372, 424, 427, 428; 200/153 T

[56] References Cited

U.S. PATENT DOCUMENTS

| | | | |
|---|---|---|---|
| 993,362 | 5/1911 | Hailwood | 362/164 |
| 1,804,665 | 5/1931 | Arbuckle | 362/289 |
| 2,011,677 | 8/1935 | Douglas | 362/212 |
| 2,027,298 | 1/1936 | Wheat | 362/212 |
| 2,947,854 | 8/1960 | Lozeau | 362/313 |
| 3,406,270 | 10/1968 | Sho | 200/153 T |
| 4,225,902 | 9/1980 | Ihikawa et al. | 362/60 |

FOREIGN PATENT DOCUMENTS

| | | | |
|---|---|---|---|
| 931720 | 4/1955 | Fed. Rep. of Germany | 200/153 T |

*Primary Examiner*—Peter A. Nelson

*Attorney, Agent, or Firm*—Robert F. Delbridge; Arne I. Fors

[57] ABSTRACT

A lamp assembly includes a housing, a lamp bulb carrier slidably mounted in the housing for reciprocating movement along the optical axis of the lamp bulb and an actuator mounted in the housing for annular movement about an axis substantially perpendicular to the optical axis of the lamp bulb. The actuator has an eccentric portion engaging the lamp bulb carrier to effect reciprocation of the lamp bulb carrier when the actuator is angularly moved, and a switch carried by the housing is connected to the lamp bulb and connectable to an electrical power supply. The actuator also has a cam which engages and actuates the switch over a predetermined range of annular movement of the actuator to cause the lamp to be illuminated while the lamp is reciprocated along its optical axis.

6 Claims, 8 Drawing Figures

FIG. 3.
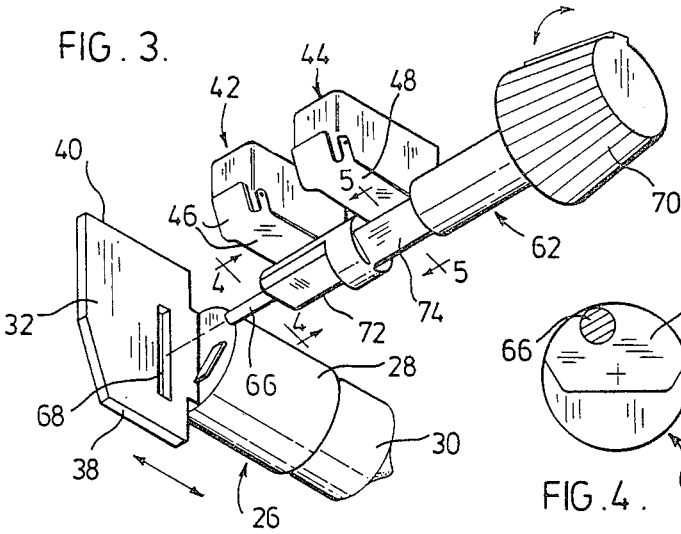
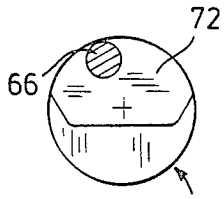
FIG. 4.
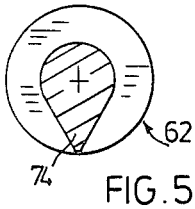
FIG. 5.
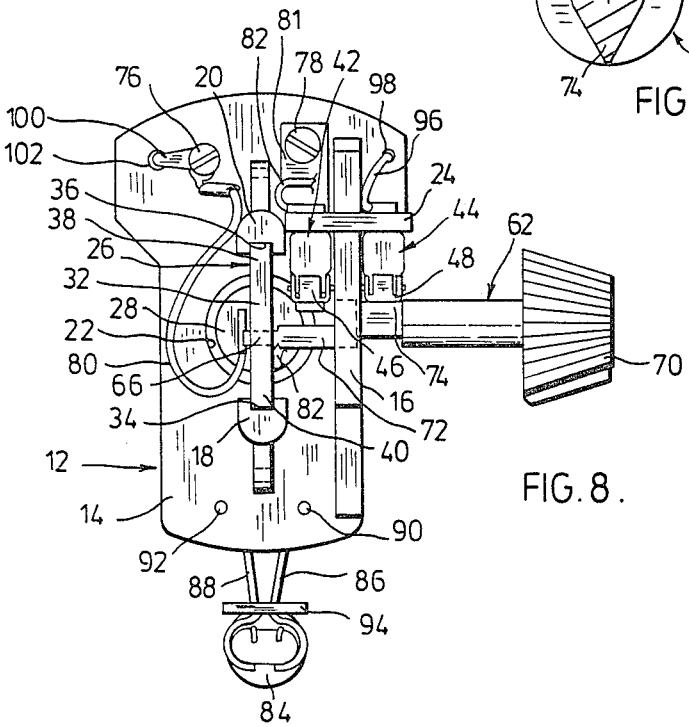
FIG. 8.

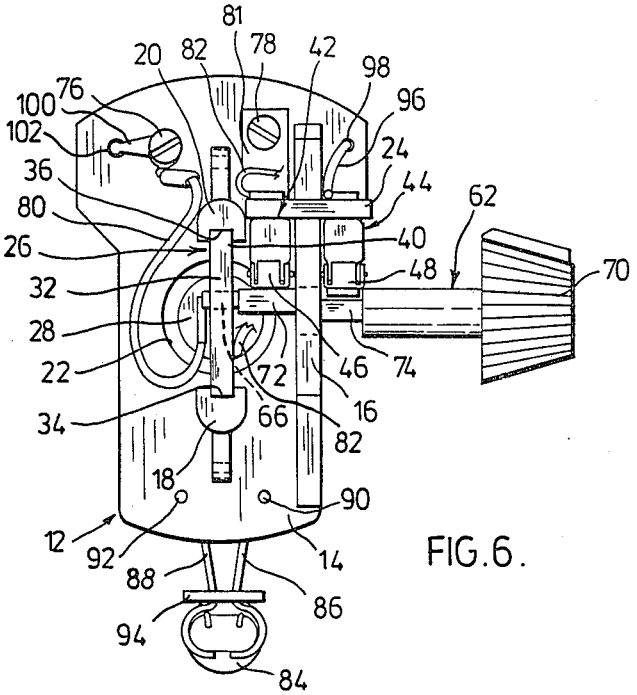
FIG. 6.
FIG. 7.
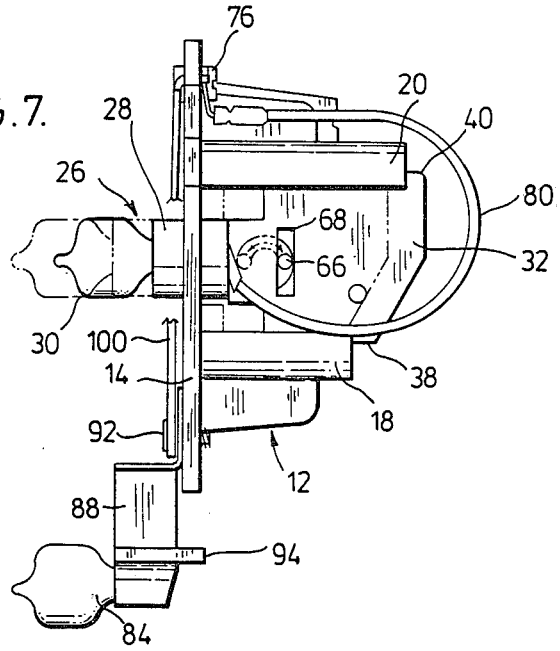

LAMP ASSEMBLY WITH SWITCH AND FOCUSSING MECHANISMS

This invention relates to lamp assemblies with switch and focussing mechanisms.

Such lamp assemblies are used for example in miners' helmets, since it is desirable for a miner not only to be able to switch a lamp on and off but also to focus the lamp for good vision at different distances. As a safety feature, such lamp assemblies may also be provided with an auxiliary light which is operable independently of the main light, so that the auxiliary light may be operated in case of failure of the main light.

Known lamp assemblies of this kind have been somewhat cumbersome in construction and/or operation and therefore it is an object of the invention to provide an improved lamp assembly of this kind.

According to the invention, a lamp assembly comprises a housing, a lamp bulb carrier slidably mounted in the housing for reciprocating movement along the optical axis of the lamp bulb, an actuator mounted in the housing for angular movement about an axis substantially perpendicular to the optical axis of the lamp bulb, said actuator having an eccentric portion engaging the lamp bulb carrier to effect reciprocation of the lamp bulb carrier when the actuator is angularly moved, and a first switch carried by the housing connected to the lamp bulb and connectable to an electrical power supply, said actuator also having first cam means which engages and actuates the first switch over a first predetermined range of angular movement of the actuator to cause the lamp to be illuminated while the lamp is reciprocated along its optical axis by angular movement of the actuator over said first predetermined range.

In use, a lamp assembly in accordance with the invention is provided with a fixed reflector with the lamp bulb carrier being reciprocable along the optical axis thereof. The lamp assembly can be constructed so as to be relatively compact and is especially suitable for use in miners' helmets. Further, a lamp assembly in accordance with the invention can readily be constructed so as to be of the necessary rugged construction required by miners' lamp assemblies.

The lamp bulb carrier may have opposite edges and the housing may have corresponding opposed grooves receiving the opposite edges to effect the slidable mounting of the lamp bulb carrier in the housing, the opposite edges being slidable in the grooves during the reciprocating movement of the lamp bulb carrier.

Also, the lamp bulb carrier may have an opening receiving the eccentric portion of the actuator, the opening having side walls engageable by the eccentric portion to effect the reciprocating movement of the lamp bulb carrier.

The housing may carry an auxiliary light and a second switch connected to the auxiliary light and connectable to the electrical power supply, with the actuator having second cam means which engages and actuates the second switch over a second predetermined range of angular movement of the actuator to cause the auxiliary light to be illuminated.

The lamp bulb in the carrier may be a dual filament lamp bulb, with one filament being connected to the first switch and the other filament providing the auxiliary light and being connected to the second switch. Alternatively, the lamp bulb in the carrier may be a single filament lamp bulb, with the auxiliary light comprising a separate single filament lamp bulb carried by the housing.

One embodiment of the invention will now be described, by way of example, with reference to the accompanying drawings, of which:

Figure 2:
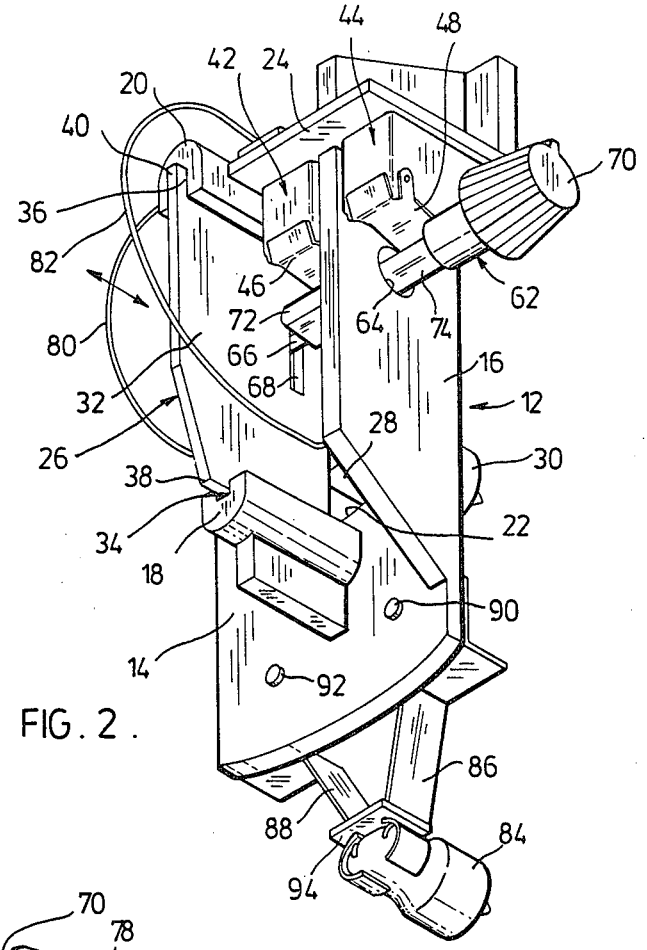
FIG. 2 is a rear perspective view.

FIG. 3 is an explosive perspective view of the moving parts of the lamp assembly, FIG. 4 is a sectional view taken along the line 4—4 of FIG. 3, FIG. 5 is a sectional view taken along the line 5—5 of FIG. 3, FIG. 6 is a rear view of the lamp assembly showing the actuator positioned to illuminate the main bulb, FIG. 7 is a side view of the lamp assembly indicating the range of focussing movement of the main bulb, and FIG. 8 is similar to FIG. 6 but showing the actuator positioned to illuminate the auxiliary bulb.

Referring to the drawing, a lamp assembly for a miners' helmet comprises a molded housing 12 of synthetic plastic material with a panel 14, a wall 16 projecting rearwardly from the panel 14 adjacent one side thereof, and lower and upper carrier supports 18, 20 projecting rearwardly from the panel 14 midway between its side edges and above and below an aperture 22 in the panel 14. The housing also has a shelf member 24 extending from the rear face of the panel on opposite sides of and near the top of the wall 16.

A lamp bulb carrier 26 also of synthetic plastic material has a front portion comprising a cylindrical lamp receiving socket 28 for a single filament lamp bulb 30 projecting through the aperture 22 in the panel 14, and a rear portion comprising a vertical wall 32. The lower and upper carrier supports 18, 20 of the housing 12 have upwardly-facing and downwardly facing grooves 34, 36 respectively extending along their length, and the vertical wall 32 of the lamp bulb carrier 26 has opposite lower and upper edges 38, 40 which are slidably mounted in the grooves 34, 36 respectively of the carrier supports 18, 20 so that the lamp bulb carrier 26 is slidable to and fro relatively to the housing 12 along the optical axis of the lamp bulb 30.

Two microswitches 42, 44 are secured to the underside of the shelf member 24 of the housing 12 on opposite sides of the wall 16, each microswitch 42, 44 having a downwardly-extending plunger (not shown) and associated pivotally mounted metal strips 46, 48, such that upward pivotal movement of the strips 46, 48 causes upward movement of the respective plungers with resultant closure of the respectively microswitch 42, 44. The microswitch 42 has three upwardly extending metal lugs (not shown) which pass through apertures (not shown) in the shelf member 24. The two outer lugs provide electrical connections to the microswitch 42, and the central lug provides means to secure the microswitch to the shelf member 24 for example by suitable adhesive. The microswitch 44 has three similar lugs.

An angularly-movable actuator 62 in the form of a short metal rod extends through an aperture 64 in the wall 16 of the housing 12. One end of the actuator 62 has an eccentric projection 66 extending into an elongated slot 68 in the vertical wall 32 of the lamp bulb carrier 26. The other end of the actuator 62 projects from the housing 12 and carries an actuating knob 70.

Adjacent the pivotable metal strip 46 of the first microswitch 42, the actuator 62 is formed as a cam 72 which extends for about 180° therearound, the arrangement being such that engagement of the cam 72 with the pivotable metal strip 46 results in upward movement of the associated plunger to close the microswitch 42. Adjacent the pivotable metal strip 48 of the other microswitch 44, the actuator 62 is formed as a cam 74 which extends over a short angular range diametrically opposite the midpoint of cam 72, the arrangement being such that engagement of the cam 74 with the pivotable metal strip 48 causes upward movement of the associated plunger to close the microswitch 44.

The upper part of the panel 14 has two electrical terminals 76, 78 extending from the front surface to the rear surface of the panel 14, the portions of the terminals 76, 78 on the front surface of the panel 14 being engageable with an electrical power supply when fitted into a miners' helmet in a manner which will be clear to a person skilled in the art. On the rear of panel 14, a wire 80 connects the terminal 76 to the lamp receiving socket portion 28 of the bulb carrier 26 which in turn is connected by a wire 82 to one of the contact lugs of the microswitch 42. The other contact lug of the microswitch 42 is connected by a metal strip 81 to the other terminal 78.

An auxiliary single filament lamp bulb 84 is mounted at the lower end of the front panel 14. Two metal strips 86, 88 are secured by screws 90, 92 to the panel 14 and extend downwardly to grip and make appropriate electrical contact with the auxiliary lamp bulb 84. The metal strips 86, 88 are maintained in the desired spaced position by a spacer 94 of electrical insulating material. One metallic strip 86 is connected by a wire 96 to one lug of microswitch 44, the wire 96 passing through an aperture 98 in the front panel 14, and the other lug of microswitch 44 is connected to the terminal 76 by an extension of the metal strip 82 which passes through the wall 16. The other metal strip 88 is connected by a wire 100 passing through an aperture 102 in the front panel 14 to the other terminal 78.

Figure 1:
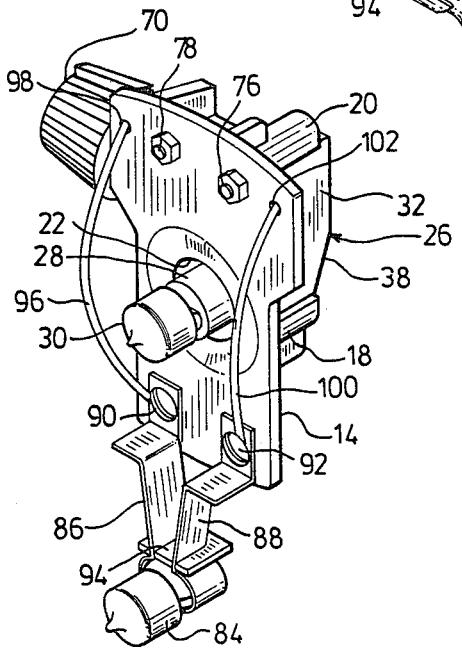
FIG. 1 is a front perspective view of a lamp assembly.

In use, the lamp assembly is installed in a miners' helmet, such that the bulbs 30 and 84 are located on the optical axes of reflectors in the helmet, as will be readily apparent to a person skilled in the art. In the position of the actuator 62 shown in FIGS. 1 to 6, the cam 72 has closed the microswitch 42 so that the main lamp 30 is on. The eccentric projection 66 is oriented with respect to the cam 72 so that, with the actuator 62 in the position shown in FIGS. 2 to 6, the lamp bulb carrier 26 is in a middle position in its reciprocating path. The actuator 62 can be rotated through nearly 90° on each side of this position, with the main lamp 30 remaining on and with main lamp 30 being reciprocated with respect to its reflector by the eccentric pin 66, as indicated in FIG. 7, thereby varying the focussing of the light for best vision at different distances.

When the actuator 62 is rotated 180° to the position shown in FIG. 8, the cam 72 will be disconnected from microswitch 42 so that the main lamp 32 will be off, and the cam 74 closes microswitch 42 so that auxiliary lamp 84 will be on. The actuator 62 is thus moved to this position if main bulb 30 fails.

Movement of the actuator 62 to a position just over 90° in either direction from the position shown in FIGS. 1 to 6 will result in neither cam 72 nor cam 74 engaging the respective microswitch 42, 44 so that both lamps 30, 34 will be off.

If desired, the single filament main bulb 30 may be replaced by a double filament bulb, and the auxiliary bulb 84 and associated parts omitted, with the second filament of the double filament bulb being appropriately connected to microswitch 44.

A person skilled in the art will readily appreciate that, instead of being mounted in a helmet, the desired lamp assembly may be mounted in a compact housing attachable to a person in some convenient manner, for example to a belt by means of a suitable clip.

The simple, rugged construction and east of operation of the described lamp assembly are readily appreciated. Other embodiments will be apparent to a person skilled in the art, the scope of the invention being defined in the appended claims.

I claim:

1. A lamp assembly comprising a housing having opposed grooves, a lamp bulb carrier having opposite edges slidably mounted in the opposed grooves of the housing for reciprocating movement along the optical axis of the lamp bulb, an actuator mounted in the housing for angular movement about an axis substantially perpendicular to the optical axis of the lamp bulb, said actuator having an eccentric portion projecting into an opening in the lamp bulb carrier, the opening having side walls engageable by the eccentric portion of the actuator to effect reciprocation of the lamp bulb carrier when the actuator is angularly moved, and a first switch carried by the housing connected to the lamp bulb and connectable to an electrical power supply, said actuator also having first cam means which engages and actuates the first switch over a first predetermined range of angular movement of the actuator to cause the lamp to be illuminated while the lamp is reciprocated along its optical axis.

2. A lamp assembly according to claim 1 wherein the housing carries an auxiliary light and a second switch connected to the auxiliary light and connectable to the electric power supply, and said actuator has second cam means which engages and actuates the second switch over a second predetermined range of angular movement of the actuator to cause the auxiliary light to be illuminated.

3. A lamp assembly according to claim 2 wherein the lamp bulb in the lamp bulb carrier is a dual filament lamp bulb, with one filament being connected to the first switch and the second filament providing the auxiliary light and being connected to the second switch.

4. A lamp assembly according to claim 2 wherein the lamp bulb in the carrier is a single filament lamp bulb, and the auxiliary light comprises a second single filament lamp bulb carried by the housing.

5. A lamp assembly according to claim 1 wherein said actuator comprises a rod-like member having one end forming said eccentric portion and an opposite end projecting from the housing for manual actuation, said first switch comprising a microswitch secured to the housing, and said actuator rod being shaped at a position between said ends to provide said first cam means adjacent said microswitch.

6. A lamp assembly according to claim 2 wherein said actuator comprises a rod-like member having one end forming said eccentric portion and an opposite end projecting from the housing for manual attraction, said first and second switches each comprising a microswitch secured to the housing, said microswitches being secured to the housing at positions spaced in the direction of the length of the actuator rod, and said actuator rod being shaped at corresponding positions between its ends to provide first and second cam means adjacent the respective microswitch.

* * * * *